US011718448B2

(12) United States Patent
Sunohara

(10) Patent No.: US 11,718,448 B2
(45) Date of Patent: Aug. 8, 2023

(54) HANDLE-EQUIPPED CONTAINER

(71) Applicant: NISSEI ASB MACHINE CO., LTD., Nagano (JP)

(72) Inventor: Makoto Sunohara, Nagano (JP)

(73) Assignee: NISSEI ASB MACHINE CO., LTD., Nagano (JP)

( * ) Notice: Subject to any disclaimer, the term of this patent is extended or adjusted under 35 U.S.C. 154(b) by 0 days.

(21) Appl. No.: 16/611,073

(22) PCT Filed: May 9, 2018

(86) PCT No.: PCT/JP2018/018001
§ 371 (c)(1),
(2) Date: Nov. 5, 2019

(87) PCT Pub. No.: WO2018/207844
PCT Pub. Date: Nov. 15, 2018

(65) Prior Publication Data

US 2020/0165034 A1 May 28, 2020

(30) Foreign Application Priority Data

May 10, 2017 (JP) ..... JP2017-093909

(51) Int. Cl.
*B65D 23/10* (2006.01)
*B65D 1/02* (2006.01)

(52) U.S. Cl.
CPC ..... *B65D 23/10* (2013.01); *B65D 1/0223* (2013.01); *B65D 1/0261* (2013.01)

(58) Field of Classification Search
CPC ..... B65D 23/10; B65D 1/0223; B65D 1/0261
(Continued)

(56) References Cited

U.S. PATENT DOCUMENTS

D219,863 S * 2/1971 Beaver ..... D9/528
7,350,657 B2 * 4/2008 Eaton ..... B65D 1/0276 220/675

(Continued)

FOREIGN PATENT DOCUMENTS

AU 2014101476 A4 1/2015
CN 1795126 A 6/2006

(Continued)

OTHER PUBLICATIONS

Office Action issued in Chinese Patent Application No. 201880030363.6, dated Jul. 24, 2020 and English Translation thereof.

(Continued)

*Primary Examiner* — Rafael A Ortiz
*Assistant Examiner* — Sanjidul Islam
(74) *Attorney, Agent, or Firm* — Greenblum & Bernstein, P.L.C.

(57) ABSTRACT

Provided is a container with handle including an upper surface portion, a side surface portion, a bottom surface portion, and a grip portion formed to the side surface portion, in which the grip portion includes a first connecting end portion, a second connecting end portion, a grip body portion, and a hollow portion, and an area of a cross section of the hollow portion cut by a plane, which passes through a first end point of the second connecting end portion closest to a central axis of the container and is orthogonal to a central axis, is larger than an area of a cross section of the hollow portion cut by a plane which is at the grip body portion and is orthogonal to the central axis.

7 Claims, 8 Drawing Sheets

(58) Field of Classification Search
USPC ..... 215/398, 370, 376, 378
See application file for complete search history.

(56) References Cited

U.S. PATENT DOCUMENTS

| | | | | |
|---|---|---|---|---|
| D792,773 | S * | 7/2017 | Dunster | D9/516 |
| 2003/0173328 | A1* | 9/2003 | Herckner | B65D 23/10 215/398 |
| 2004/0000568 | A1* | 1/2004 | Hansen | B65D 1/0223 222/465.1 |
| 2004/0241360 | A1 | 12/2004 | Giblin et al. | |
| 2010/0237086 | A1* | 9/2010 | Matsumura | B65D 23/10 220/752 |
| 2012/0305575 | A1* | 12/2012 | Burgess | B65D 1/0261 220/608 |
| 2012/0318767 | A1 | 12/2012 | Burgess et al. | |
| 2015/0151869 | A1* | 6/2015 | Dominguez | B29D 22/003 425/522 |
| 2016/0207243 | A1 | 7/2016 | Ozaki et al. | |
| 2017/0158370 | A1* | 6/2017 | Kuhar | B65D 25/42 |

FOREIGN PATENT DOCUMENTS

| | | | | |
|---|---|---|---|---|
| CN | 105451965 | A | 3/2016 | |
| CN | 206031988 | U | 3/2017 | |
| JP | H08-323845 | A | 12/1996 | |
| JP | 2004-276953 | | 10/2004 | |
| JP | 2004276953 | A * | 10/2004 | |
| JP | 2014-519454 | | 8/2014 | |
| JP | 2015-134641 | | 7/2015 | |
| JP | 2015134641 | A * | 7/2015 | B65D 79/005 |
| NL | 2009586 | C2 | 4/2014 | |
| WO | 99/022994 | A1 | 5/1999 | |
| WO | 2007/098837 | A1 | 9/2007 | |
| WO | 2015/093369 | A1 | 6/2015 | |
| WO | WO-2015137942 | A1 * | 9/2015 | B65D 47/06 |
| WO | WO-2018044615 | A1 * | 3/2018 | B65D 41/04 |

OTHER PUBLICATIONS

Official Communication (ISA 210) issued in International Bureau of WIPO Patent Application No. PCT/JP2018/018001, dated Jul. 10, 2018.

Official Communication (ISA 237) issued in International Bureau of WIPO Patent Application No. PCT/JP2018/018001, dated Jul. 10, 2018, along with an English translation thereof.

Extended European Search Report issued in European Paient Office (EPO) Counterpart Patent Appl. No. 18798300.2, dated Jan. 26, 2021.

Office Action issued in Chinese Counterpart Patent Appl. No. 201880030363.6, dated Apr. 22, 2021, along with an English translation thereof.

* cited by examiner

HANDLE-EQUIPPED CONTAINER

TECHNICAL FIELD

The present invention relates to a container with handle that is filled with fluid such as liquid.

BACKGROUND ART

There is a container called a returnable container that can be washed and used repeatedly among containers used as a water server or the like. For example, Patent Literature 1 discloses a container (high strength bottle) to which a hollow handle is provided.

CITATION LIST

Patent Literature

Patent Literature 1: JP-T-2014-519454

SUMMARY OF INVENTION

Technical Problem

In general, in a state where the returnable container is reversed at the time of washing, washing water or the like is splashed toward a center of a bottom surface portion from an inlet and outlet portion, and each part of an inner wall surface of the bottle is washed.

However, the container to which the hollow handle is provided as described in Patent Literature 1 may be difficult to wash since there is a place where the washing water or rinse water is difficult to reach in a part of the hollow handle at the time of washing.

An object of the present invention is to provide a container with handle in which an interior of the handle can be easily washed.

Solution to Problem

A container with handle of the present invention that can solve the above problem is capable of containing a predetermined amount of fluid, the container with handle including:

an upper surface portion to which an inlet and outlet portion of liquid is formed;

a side surface portion connected to the upper surface portion;

a bottom surface portion disposed on a side opposite to the upper surface portion and connected to the side surface portion; and a hollow and long grip portion formed to the side surface portion, in which the grip portion includes:

- a first connecting end portion connected with the side surface portion;
- a second connecting end portion connected with the side surface portion at a position closer to the bottom surface portion than the first connecting end portion;
- a grip body portion disposed between the first connecting end portion and the second connecting end portion; and
- a hollow portion communicating with an interior of the container, and an area of a cross section of the hollow portion cut by a plane, which passes through a first end point of the second connecting end portion closest to a central axis of the container passing through the inlet and outlet portion and is orthogonal to the central axis, is larger than an area of a cross section of the hollow portion cut by a plane which is at the grip body portion and is orthogonal to the central axis.

In the container with handle, the area of the cross section of the hollow portion cut by the plane which passes through the first end point and is orthogonal to the central axis is larger than the area of the cross section of the hollow portion cut by the plane which is at the grip body portion and is orthogonal to the central axis. Therefore, in a case where washing water or the like is splashed from the inlet and outlet portion to the bottom surface portion in a state in which the container is reversed at the time of washing, the washing water or rinse water that is difficult to drop along the inner wall surface of the bottom surface portion is guided toward the second connecting end portion serving as an inlet to the interior of the grip portion, and is easily accumulated on a wall surface of the grip body portion. Therefore, a place where the washing water or rinse water is difficult to reach is difficult to occur in the hollow grip portion, and the container with handle can be easily washed.

In the container with handle of the present invention, it is preferable that the grip body portion includes a part that is reduced in diameter from the second connecting end portion toward the first connecting end portion when the container is viewed from the side surface portion side so that the central axis of the container passing through the inlet and outlet portion of the liquid overlaps with the grip body portion.

According to the above configuration, the washing water or rinse water guided toward the second connecting end portion and accumulated at the time of washing easily spreads and drops while merging with the surrounding washing water or rinse water on the inner wall surface of the grip portion. Therefore, water easily spreads widely on the inner wall surface of the grip body portion, and the container with handle can be easily washed. In addition, easiness of holding the grip portion is also improved.

In the container with handle of the present invention, it is preferable that the area of the cross section of the hollow portion cut by the plane which passes through the first end point and is orthogonal to the central axis is larger than an area of a cross section of the hollow portion cut by a plane which passes through a second end point of the first connecting end portion closest to the central axis of the container passing through the inlet and outlet portion and is orthogonal to the central axis.

According to the above configuration, the washing water or rinse water easily spreads and drops to the first connecting end portion serving as an outlet of the washing water or rinse water while merging with the surrounding washing water or rinse water due to pressure loss and friction loss on the inner wall surface of the grip portion, and the container with handle can be easily washed.

In the container with handle of the present invention, it is preferable that the side surface portion has a concave portion to which the first connecting end portion and the second connecting end portion are connected, and a surface connected with the first connecting end portion among surfaces configuring the concave portion is inclined so as to come close to the bottom surface portion as the surface comes close to the central axis of the container.

According to the above configuration, the washing water or rinse water that is difficult to drop along the inner wall surface of the concave portion is guided to a surface on the upper surface portion side of the concave portion at the time of washing, a place where the washing water or rinse water is difficult to reach is difficult to occur, and the container with handle can be easily washed.

In the container with handle of the present invention, it is preferable that a convex rib portion extending along a longitudinal direction of the grip portion is formed on at least a part of the surfaces configuring the concave portion.

According to the above configuration, it is possible to improve strength of the container against impact at the time of falling.

In the container with handle of the present invention, it is preferable that the grip body portion is curved.

According to the above configuration, the washing water or rinse water guided toward the second connecting end portion and accumulated at the time of washing more easily spreads and drops while merging with the surrounding washing water or rinse water on the inner wall surface of the grip portion. Therefore, the container with handle can be more easily washed. In addition, easiness of holding the grip portion is further improved.

Advantageous Effects of Invention

According to the present invention, it is possible to provide a container with handle in which an interior of the handle can be easily washed.

DESCRIPTION OF EMBODIMENTS

First Embodiment

Hereinafter, an example of embodiments (first embodiment) of a container with handle according to the present invention will be described with reference to the drawings.

Figure 1:
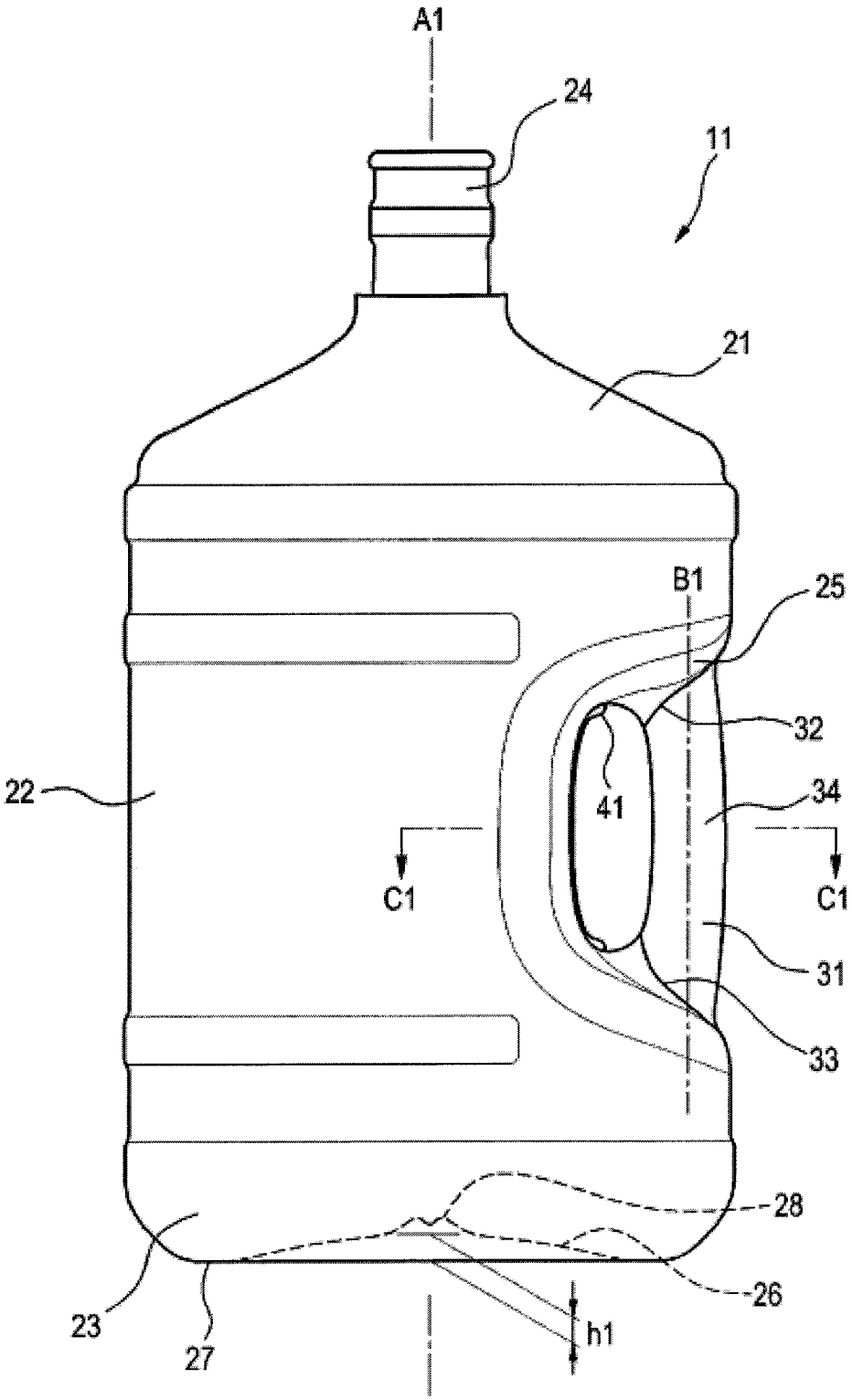
FIG. 1 is a side view showing a container with handle according to a first embodiment.
Figure 2:
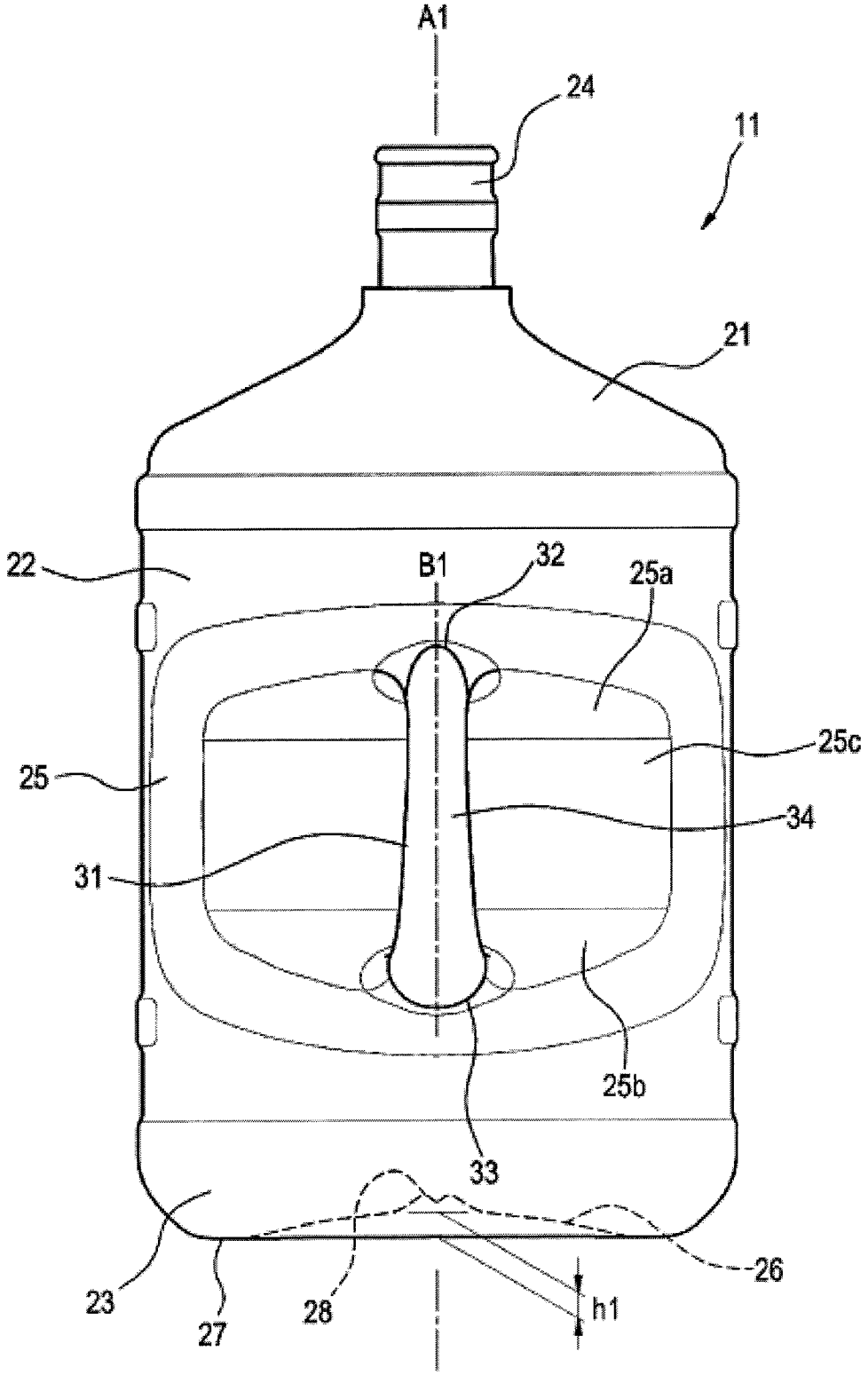
FIG. 2 is a side view showing the container with handle according to the first embodiment.

FIG. 1 to FIG. 4 are views showing a container 11 with handle according to the first embodiment of the present invention. As shown in FIG. 1 and FIG. 2, in the present embodiment, the container 11 with handle includes an upper surface portion 21, a side surface portion 22 connected to the upper surface portion 21, a bottom surface portion 23 disposed on a side opposite to the upper surface portion 21 and connected to the side surface portion 22, and a hollow and long grip portion 31 formed to the side surface portion 22. A predetermined amount of fluid such as liquid (such as drinking water) can be contained in an interior of the container 11.

The upper surface portion 21 forms an upper surface of the container 11 with handle, and a cylindrical inlet and outlet portion 24 projecting upward is formed to a center of the upper surface. Fluid is made to flow from the inlet and outlet portion 24 into the interior of the container 11 with handle. The liquid in the container 11 with handle is discharged from the inlet and outlet portion 24. A cap can be attached to the inlet and outlet portion 24. The cap can be attached to and detached from the inlet and outlet portion 24, and the container 11 with handle is sealed by attaching the cap to the inlet and outlet portion 24.

The side surface portion 22 forms a peripheral surface of the container 11 with handle, and is connected to the upper surface portion 21 and extends downward. The bottom surface portion 23 forms a bottom surface of the container 11 with handle, and is disposed on the side opposite to the upper surface portion 21 and is connected to the side surface portion 22. The bottom surface portion 23 includes an upper bottom portion 26 formed in a concave shape gradually extending toward the upper surface portion 21 of the container 11 as it extends toward a central axis A1 of the container 11. Except for the vicinity of a central portion of the upper bottom portion 26, the upper bottom portion 26 is formed so as to curve with a substantially constant radius of curvature in a cross-sectional shape in a case where the upper bottom portion 26 is cut by a plane passing through the central axis A1. When the container 11 is installed on a horizontal plane with the bottom surface portion 23 facing downward, the bottom surface portion 23 includes a peripheral bottom portion 27 formed along the horizontal plane. The upper bottom portion 26 is provided on an inner side of the peripheral bottom portion 27. An overhanging portion 28 that overhangs toward the upper surface portion 21 is further formed in the central portion of the upper bottom portion 26. A height h1 from the horizontal plane to the center of the upper bottom portion 26 (a height from the horizontal plane to the center of the upper bottom portion 26 in a case where it is assumed that the overhanging portion 28 is not formed and the upper bottom portion 26 extends to the center with a substantially constant radius of curvature) when the container 11 is installed on the horizontal plane with the bottom surface portion 23 facing downward is 10 mm or more and 50 mm or less.

The container 11 is formed so as to be line-symmetric with the central axis A1 of the container 11 that passes through the inlet and outlet portion 24 when the container 11 is viewed from the grip portion 31 side as shown in FIG. 2. In description of the present embodiment, a time when the container 11 is viewed from the grip part 31 side (FIG. 2) so that the container 11 is line-symmetric with the central axis A1 of the container 11 that passes through the inlet and outlet portion 24 is simply described as "when the container 11 is viewed from the front". In the description of the present embodiment, a time when the container 11 is viewed by rotating the container 11 counterclockwise by 90° about the central axis A1 from the time when the container 11 is viewed from the front (FIG. 1) is simply described as "when the container 11 is viewed from the left".

A concave portion 25 that is concave toward the central axis A1 of the container 11 is formed in the side surface portion 22. The concave portion 25 is formed by a first surface 25*a* on the upper surface 21 side, a second surface 25*b* on the bottom surface portion 23 side, and a third surface 25*c* connecting with the first surface 25*a* and the second surface 25*b*. When the container 11 is viewed from the left, a through hole is formed between the concave portion 25 and the grip portion 31. The first surface 25*a* is inclined to come close to the bottom surface portion 23 as it comes close to the central axis A1 of the container 11. The second surface 25*b* is inclined to come close to the upper surface portion 21 as it comes close to the central axis A1 of the container 11.

A convex rib portion (fin) 41 extending along a longitudinal direction of the grip portion 31 is formed on a central portion of the third surface 25*c*. An outer edge of the through hole formed by the concave portion 25 and the grip portion 31 and adjacent areas thereof are collectively referred to as a pinch-off portion. The pinch-off portion is formed by inflating a bottomed preform having the inlet and outlet portion 24 under air pressure in a blow mold, then advancing two insert molds provided so as to face the concave portion 25 in the horizontal direction to come close to each other, and crimping (welding) the surrounding resin. The resin positioned in the through hole is removed after blow molding. The convex rib portion 41 is formed only on the pinch-off portion on the concave portion 25 side formed in a series of steps, that is, the third surface 25*c* of the concave portion 25.

Figure 3:
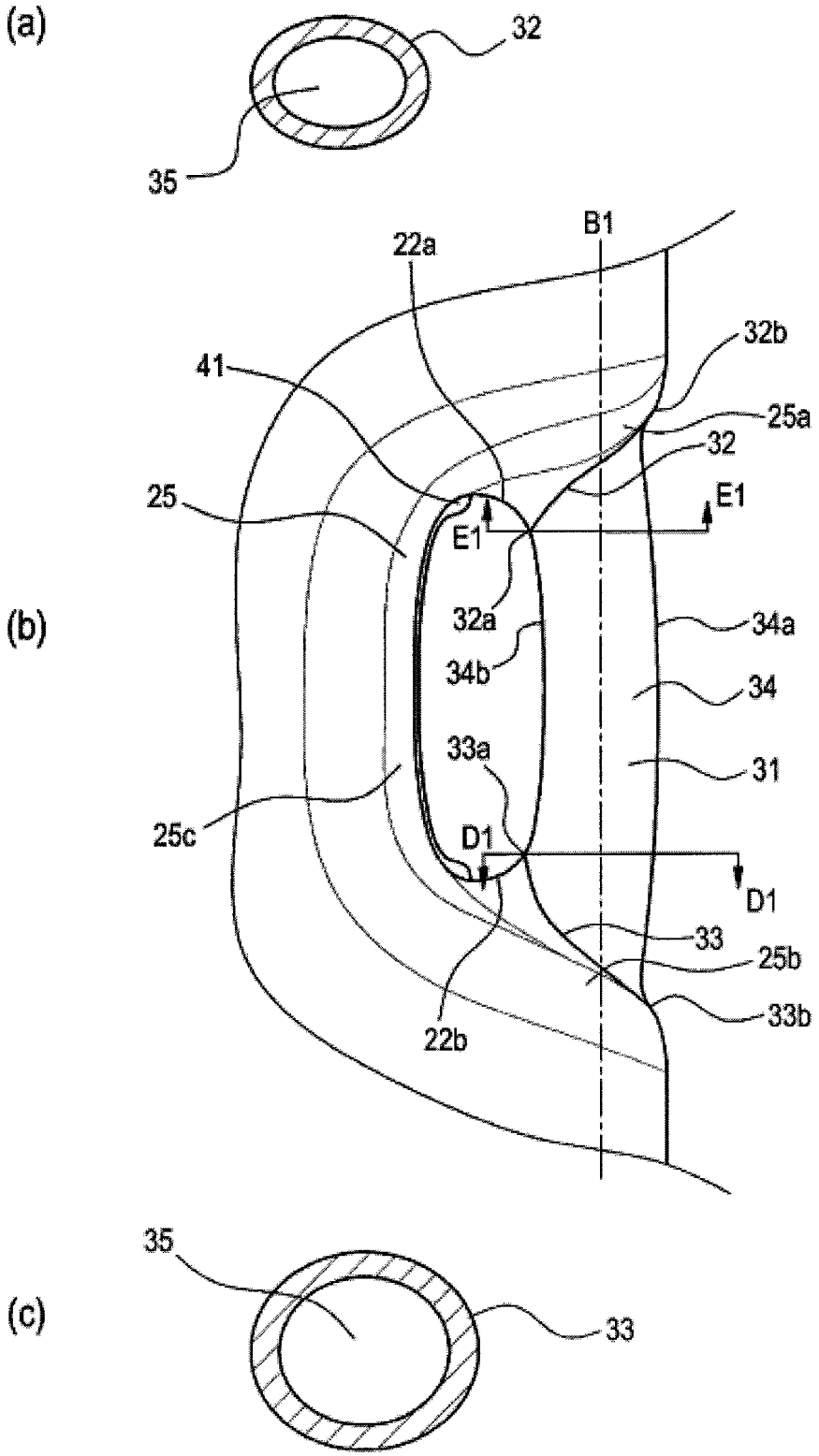
FIG. 3 is a diagram showing an enlarged view (b) of a grip portion of the container with handle according to the first embodiment, a D1-D1 cross section (c) of the grip portion which passes through a first end point and is orthogonal to a central axis, and an E1-E1 cross section (a) of the grip portion which passes through a second end point and is orthogonal to the central axis.

FIG. 3 is a diagram showing an enlarged view (b) of the grip portion 31 of the container 11, a D1-D1 cross section (c) of the grip portion 31 which passes through a first end point 33*a* and is orthogonal to the central axis A1, and an E1-E1 cross section (a) of the grip portion 31 which passes through a second end point 32*a* and is orthogonal to the central axis A1. A line B1 passing through the grip portion 31 shown in FIG. 1 to FIG. 3 is an imaginary line parallel with the central axis A1.

The grip portion 31 formed to the side surface portion 22 includes a first connecting end portion 32 connected with the first surface 25*a* of the concave portion 25 of the side surface portion 22, a second connecting end portion 33 connected with the second surface 25*b* of the concave portion 25 of the side surface portion 22 at a position closer to the bottom surface portion 23 than the first connecting end portion 32, a curved grip body portion 34 disposed between the first connecting end portion 32 and the second connecting end portion 33, and a hollow portion 35 communicating with the interior of the container 11.

A grip body portion 34 defines an arc-shaped first curve 34*a* and an arc-shaped second curve 34*b* closer to the central axis A1 of the container 11 than the first curve 34*a* when the container 11 is viewed from the left. The side surface portion 22 defines an arc-shaped third curve 22*b* extending from the first end point 33*a* of the bottom surface portion 23 side of the second curve 34*b* to the bottom surface portion 23 side and an arc-shaped fourth curve 22*a* extending from the second end point 32*a* on the upper surface portion 21 side of the second curve 34*b* to the upper surface portion 21 side when the container 11 is viewed from the left. A radius of curvature of the second curve 34*b* is larger than a radius of curvature of the third curve 22*b* and the fourth curve 22*a*. Although the present invention is not particularly limited, in the present embodiment, the radius of curvature of the second curve 34*b* is twice or larger than the radius of curvature of the third curve 22*b* and the fourth curve 22*a*. When the container 11 is viewed from the left, radii of curvature of curves (22*b*, 34*b*, 22*a*) defined by the grip body portion 34 and the side surface portion 22 change significantly with the first end point 33*a* and the second end point 32*a* as boundaries. The first end point 33*a* is a point of the second connecting end portion 33 that is closest to the central axis A1 of the container 11. The second end point 32*a* is a point of the first connecting end portion 32 that is closest to the central axis A1 of the container 11.

When the container 11 is viewed from the left, the first curve 34*a* of the grip body portion 34 is connected to the second surface 25*b* of the concave portion 25 by a third end point 33*b*. The third end point 33*b* is an inflection point of the first curve 34*a*. A center of curvature of the first curve 34*a* near the third end point 33*b* is present on a side opposite to the central axis A1 with respect to the first curve 34*a*, and a center of curvature of a curve ahead of the third end point 33*b* with respect to the first curve 34*a* is present on the central axis A1 side with respect to the curve.

When the container 11 is viewed from the left, the first curve 34*a* of the grip body portion 34 is connected to the first surface 25*a* of the concave portion 25 by a fourth end point 32*b*. The fourth end point 32*b* is an inflection point of the first curve 34*a*. A center of curvature of the first curve 34*a* near the fourth end point 32*b* is present on a side opposite to the central axis A1 with respect to the first curve 34*a*, and a center of curvature of a curve ahead of the fourth end point 32*b* with respect to the first curve 34*a* is present on the central axis A1 side with respect to the curve.

The first connecting end portion 32 is formed to pass through the second end point 32*a* and the fourth end point 32*b* when the container 11 is viewed from the left. The second connecting end portion 33 is formed to pass through the first end point 33*a* and the third end point 33*b* when the container 11 is viewed from the left.

The grip body portion 34 is reduced in diameter from the second connecting end portion 33 toward the first connecting end portion 32 when the container 11 is viewed from the front (see FIG. 2).

Figure 4:
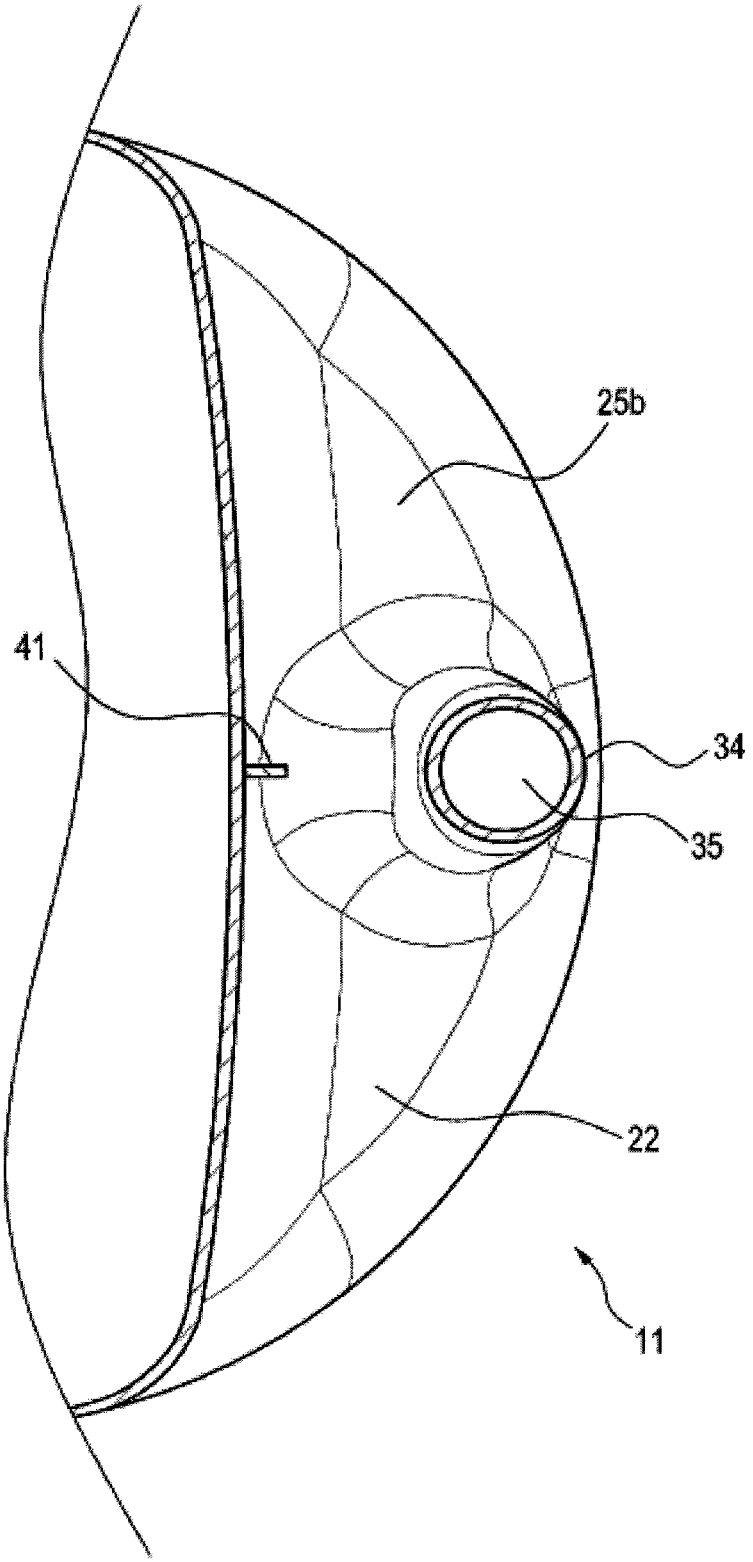
FIG. 4 is a view showing a C1-C1 cross section of the container with handle according to the first embodiment.

FIG. 4 shows a C1-C1 cross section of the side surface portion 22 and the grip portion 31 of the container 11 that is orthogonal to the central axis A1.

An area of a cross section (see (c) of FIG. 3) of the hollow portion 35 cut by a plane which passes through the first end point 33*a* and is orthogonal to the central axis A1 is larger than an area of a cross section (see FIG. 4) of the hollow portion 35 cut by a plane which is at the grip body portion 34 above the first end point 33*a* and below the second end point 32*a* and is orthogonal to the central axis A1. The area of the cross section of the hollow portion 35 cut by a plane which passes through the first end point 33*a* and is orthogonal to the central axis A1 is larger than an area of a cross section (see (a) of FIG. 3) of the hollow portion 35 cut by a plane which passes through the second end point 32*a* and is orthogonal to the central axis A1.

In the container of related art, a hollow and long handle is formed to have a substantially constant diameter along the longitudinal direction. In a case where washing water or the like is splashed from the inlet and outlet portion to the bottom surface portion in a state in which the container with such configuration is reversed, a part of the washing water drops along an inner wall surface of the bottom surface portion, but there may be a place where the washing water is difficult to spread, that is, a place where the washing water is difficult to reach and difficult to become wet. Similarly, rinse water for rinse is difficult to spread, and the washing water may remain on a part of an inner wall surface of the handle.

However, in the container 11 of the present embodiment, the area of the cross section of the hollow portion 35 cut by a plane which passes through the first end point 33*a* and is orthogonal to the central axis A1 is larger than the area of the cross section of the hollow portion 35 cut by a plane which is at the grip body portion 34 and is orthogonal to the central axis A1. Thus, in a case where the washing water or the like is splashed from the inlet and outlet portion 24 to the bottom surface portion 23 in a state in which the container is reversed at the time of washing, the washing water or rinse water that is difficult to drop along the inner wall surface of the bottom surface portion 23 is guided toward the second connecting end portion 33 serving as an inlet to the interior of the grip portion 31, and is easily accumulated on a wall surface of the grip body portion 34. Therefore, a place where the washing water or rinse water is difficult to reach is difficult to occur in the hollow grip portion 31, and the container 11 can be easily washed.

Further, according to the container 11 of the present embodiment, since the grip body portion 34 is reduced in diameter from the second connecting end portion 33 toward the first connecting end portion 32, the washing water or rinse water guided toward the second connecting end portion 33 and accumulated at the time of washing easily spreads and drops while merging with the surrounding washing water or rinse water due to pressure loss and friction loss on the inner wall surface of the grip portion 34. Therefore, water easily spreads widely on the inner wall surface of the grip body portion 34, and the container 11 can be easily washed. In addition, the grip portion 31 on the upper surface portion 21 side that is grasped by a user is reduced in diameter to have an elliptical cross-sectional shape, so that easiness of holding is also improved.

In the container 11 of the present embodiment, the area of the cross section of the hollow portion 35 cut by a plane which passes through the first end point 33*a* and is orthogonal to the central axis A1 is larger than the area of the cross section of the hollow portion 35 cut by a plane which passes through the second end point 32*a* and is orthogonal to the central axis A1. Thus, the accumulated washing water or rinse water easily spreads and drops to the first connecting end portion 32 serving as an outlet of the washing water or rinse water while merging with the surrounding washing water or rinse water due to pressure loss and friction loss on the inner wall surface of the grip portion 34, and the container 11 can be easily washed.

In the container 11 of the present embodiment, the first surface 25*a* of the concave portion 25 is inclined to come close to the bottom surface portion 23 as it comes close to the central axis A1 of the container 11. Thus, the washing water or rinse water that is difficult to drop along the inner wall surface of the concave portion 25 is guided to the first surface 25*a* of the concave portion 25 at the time of washing, a place where the washing water or rinse water is difficult to reach is difficult to occur, and the container 11 can be easily washed. In the container 11 of the present embodiment, the second surface 25*b* of the concave portion 25 is inclined to come close to the upper surface portion 21 as it comes close to the central axis A1 of the container 11. Thus, the washing water or rinse water that is difficult to drop along the inner wall surface of the bottom surface portion 23 at the time of washing is further guided toward the second connecting end portion 33 serving as the inlet to the interior of the grip portion 31, and is easily accumulated. Therefore, a place where the washing water or rinse water is difficult to reach is difficult to occur in the hollow grip portion 31, and the container 11 can be easily washed.

Further, according to the container 11 of the present embodiment, since the convex rib portion 41 extending along the longitudinal direction of the grip portion 31 is formed on a central part of the third surface 25*c*, strength of the container 11 against impact at the time of falling can be improved. The strength of the container 11 in the vicinity of the first connecting end portion 32 and the second connecting end portion 33 can be improved due to the convex rib portion 41.

Further, according to the container 11 of the present embodiment, since the grip body portion 34 is curved, the washing water or rinse water guided toward the second connecting end portion 33 and accumulated at the time of washing easily spreads and drops while merging with the surrounding washing water or rinse water on the inner wall surface of the grip portion 34. Therefore, the container 11 can be further easily washed. In addition, easiness of holding the grip portion 31 can be further improved.

In the container 11 of the present embodiment, the height h1 from the horizontal plane to the center of the upper bottom portion 26 is 10 mm or more and 50 mm or less when the container 11 is installed on the horizontal plane with the bottom surface portion 23 facing downward. When the height h1 is 10 mm or more, in a case where the container 11 filled with liquid falls, water hammering action (water hammer) acting on the pinch-off portion can be reduced by downward elastic deformation of the upper bottom portion 26. This makes it possible to improve falling resistance of the container 11. An upper limit of the height h1 is preferably 50 mm or less in view of capacity and formability of the container 11. The height h1 is more preferably 15 mm or more and 45 mm or less, and particularly preferably 20 mm or more and 35 mm or less.

As described above, according to the embodiment, it is possible to provide a container 11 with handle in which an interior of the handle can be easily washed.

Second Embodiment

Hereinafter, another example (second embodiment) of embodiments of a container with handle according to the present invention will be described with reference to the drawings.

Figure 5:
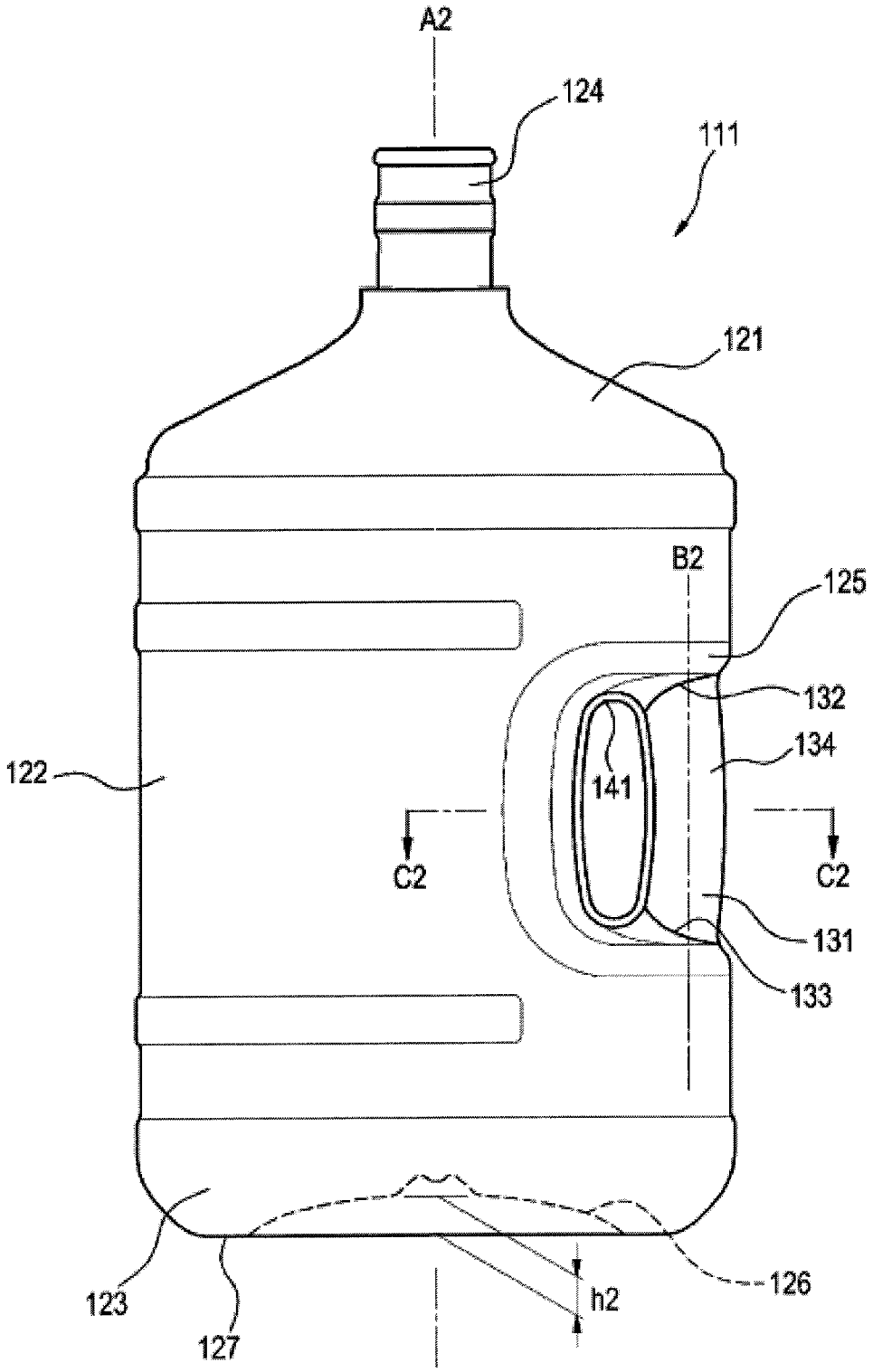
FIG. 5 is a side view showing a container with handle according to a second embodiment.
Figure 6:
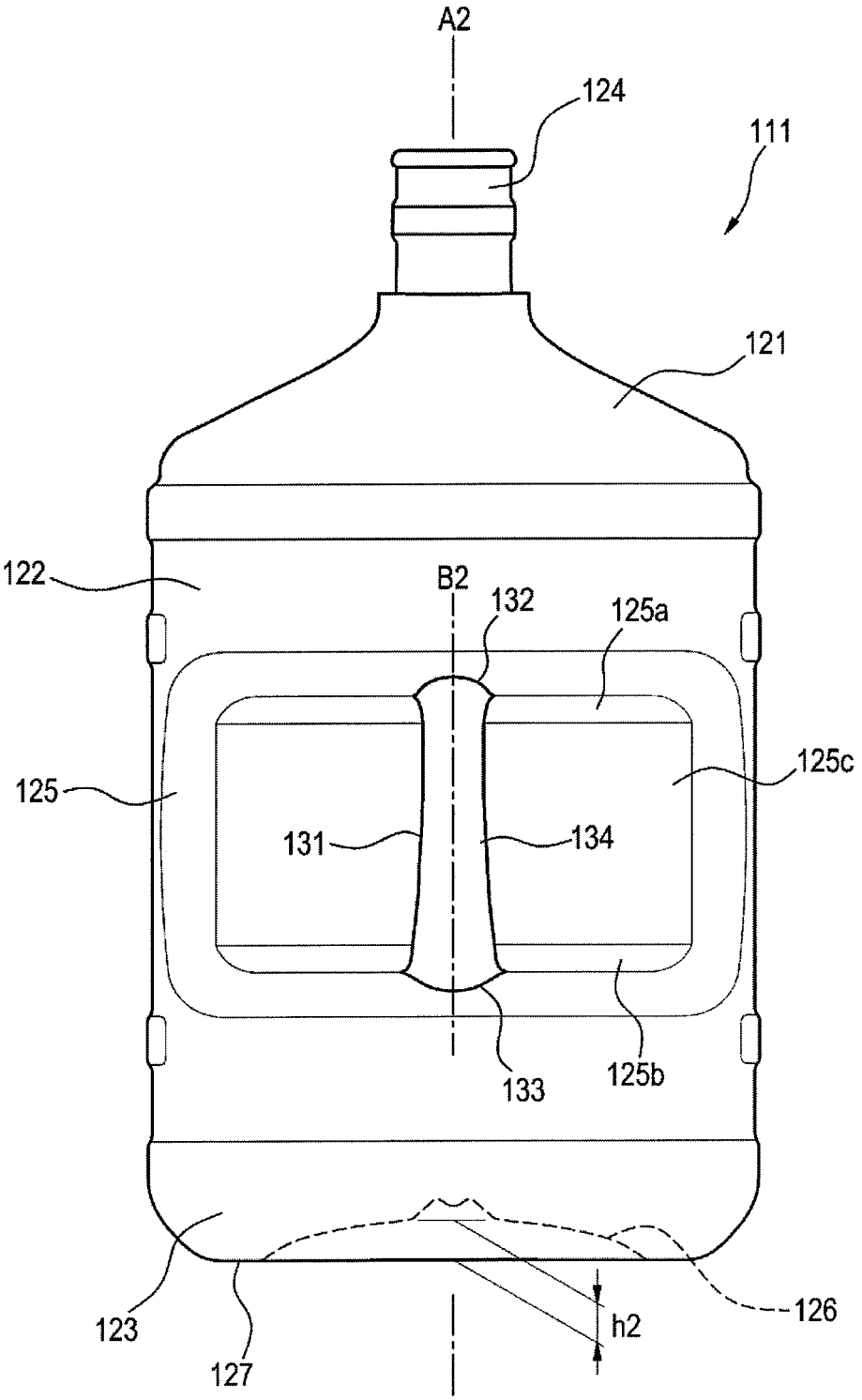
FIG. 6 is a side view showing the container with handle according to the second embodiment.

FIG. 5 to FIG. 8 are views showing a container 111 with handle according to the second embodiment of the present invention. As shown in FIG. 5 and FIG. 6, in the present embodiment, the container 111 with handle includes an upper surface portion 121, a side surface portion 122 connected to the upper surface portion 121, a bottom surface portion 123 disposed on a side opposite to the upper surface portion 121 and connected to the side surface portion 122, and a hollow and long grip portion 131 formed to the side surface portion 122. A predetermined amount of fluid such as liquid (such as drinking water) can be contained in the interior of the container 11.

Here, since the upper surface portion 121 has the same configuration as the upper surface portion 21 of the first embodiment, a description thereof is omitted.

The side surface portion 122 forms a peripheral surface of the container 111 with handle, and is connected to the upper surface portion 121 and extends downward. The bottom surface portion 123 includes an upper bottom portion 126 and a peripheral bottom portion 127. Since the peripheral bottom portion 127 has the same configuration as the peripheral bottom portion 27 according to the first embodiment, a description thereof is omitted. The upper bottom portion 126 has the same configuration as the upper bottom portion 26 according to the first embodiment except that a height h2 from a horizontal surface to the center of the upper bottom portion 126 is different when the container 111 is installed on the horizontal plane with the bottom surface portion 123 facing downward, so that detailed description is omitted. The height h2 from the horizontal plane to the center of the upper bottom portion 126 (defined similarly to the height h1 defined in the first embodiment) is 20 mm or more and 35 mm or less.

In the description of the present embodiment, a time when the container 111 is viewed from the front (FIG. 6) and a time when the container 111 is viewed from the left (FIG. 7) are referred to in an appropriate scene based on definition similar to the definition described in the first embodiment. The container 111 is formed to be line-symmetric with a central axis A2 of the container 111 passing through an inlet and outlet portion 124 when the container 111 is viewed from the front (FIG. 6).

A concave portion 125 that is concave toward the central axis A2 of the container 111 is formed in the side surface portion 122. The concave portion 125 is formed by a first surface 125*a* on the upper surface 121 side, a second surface 125*b* on the bottom surface portion 123 side, and a third surface 125*c* connecting with the first surface 125*a* and the second surface 125*b*. When the container 111 is viewed from the left, a through hole is formed between the concave portion 125 and the grip portion 131. The first surface 125*a* and the second surface 125*b* are formed to be substantially orthogonal to the central axis A2 in a part excluding a place connecting with the side surface portion 122 other than the third surface 125*c*, the grip portion 131, and the concave portion 125.

When the container 111 is viewed from the left, on a part configuring the through hole of the concave portion 125 and the grip portion 131, a convex rib portion (fin) 141 extending along the through hole is formed. In the same manner as described in the first embodiment, an outer edge of the through hole formed by the concave portion 125 and the grip portion 131 and adjacent areas thereof are collectively referred to as a pinch-off portion. The pinch-off portion is formed by the aspect described in the first embodiment. In the present embodiment, the convex rib portion 141 is formed on the pinch-off portion of the concave portion 125 side and the grip portion 131, which is formed in the series of steps.

Figure 7:
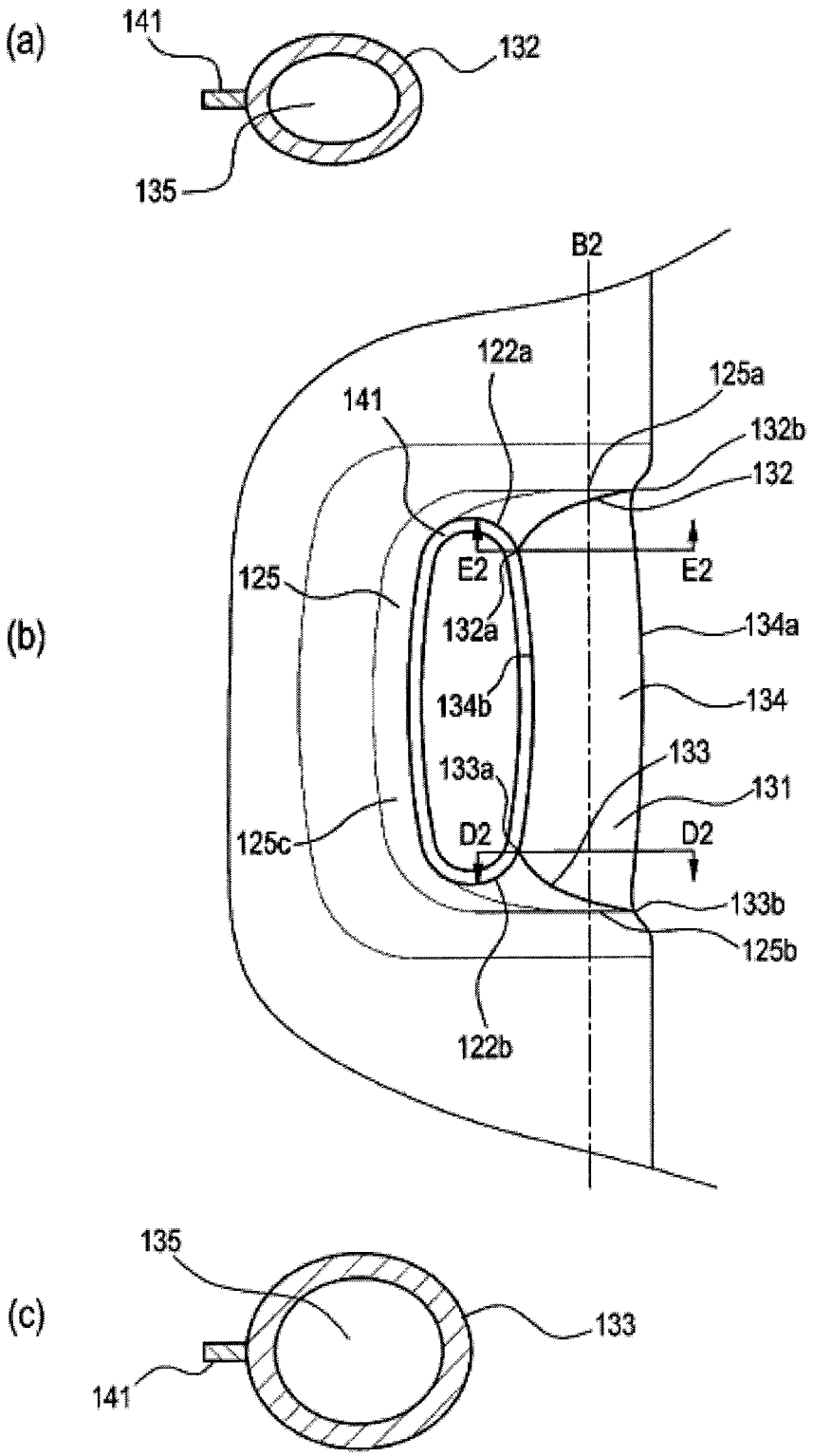
FIG. 7 is a diagram showing an enlarged view (b) of a grip portion of the container with handle according to the second embodiment, a D2-D2 cross section (c) of the grip portion which passes through a first end point and is orthogonal to a central axis, and an E2-E2 cross section (a) of the grip portion which passes through a second end point and is orthogonal to the central axis.

FIG. 7 is a diagram showing an enlarged view (b) of the grip portion 131 of the container 111, a D2-D2 cross section (c) of the grip portion 131 which passes through a first end point 133*a* and is orthogonal to the central axis A2, and an E2-E2 cross section (a) of the grip portion 131 which passes through a second end point 132*a* and is orthogonal to the central axis A2. A line B2 passing through the grip portion 131 shown in FIG. 5 to FIG. 7 is an imaginary line parallel with the central axis A2.

The grip portion 131 formed to the side surface portion 122 includes a first connecting end portion 132 connected with the first surface 125*a* of the concave portion 125 of the side surface portion 122, a second connecting end portion 133 connected with the second surface 125*b* of the concave portion 125 of the side surface portion 122 at a position closer to the bottom surface portion 123 than the first connecting end portion 132, a curved grip body portion 134 disposed between the first connecting end portion 132 and the second connecting end portion 133, and a hollow portion 135 communicating with the interior of the container 111.

The grip body portion 134 defines a first curve 134*a* and a second curve 134*b* when the container 111 is viewed from the left. The side surface portion 122 defines a third curve 122*b* extending from the first end point 133*a* and a fourth curve 122*a* extending from the second end point 132*a* when the container 111 is viewed from the left. The first curve 134*a*, the second curve 134*b*, the third curve 122*b*, the fourth curve 122*a*, the first end point 133*a*, and the second end point 132*a* have the same configuration as the first curve 34*a*, the second curve 34*b*, the third curve 22*b*, the fourth curve 22*a*, the first end point 33*a*, and the second end point 32*a*.

When the container 111 is viewed from the left, the first curve 134*a* of the grip body portion 134 is connected with the second surface 125*b* of the concave portion 125 by a third end point 133*b*. The third end point 133*b* is a point near an inflection point of the first curve 134*a*. At the inflection point near the third end point 133*b*, a center of curvature of the first curve 134*a* moves from the central axis A2 side to an opposite side of the central axis A2 with respect to the first curve 134*a* and moves from the opposite side of the central axis A2 to the central axis A2 side with respect to the first curve 134*a*.

When the container 111 is viewed from the left, the first curve 134*a* of the grip body portion 134 is connected to the first surface 125*a* of the concave portion 125 by a fourth end point 132*b*. The fourth end point 132*b* is a point near the inflection point of the first curve 134*a*. At the inflection point near the fourth end point 132*b*, a center of curvature of the first curve 134*a* moves from the central axis A2 side to an opposite side of the central axis A2 with respect to the first curve 134*a* and moves from the opposite side of the central axis A2 to the central axis A2 side with respect to the first curve 134*a*.

The first connecting end portion 132 is formed to pass through the second end point 132*a* and the fourth end point 132*b* when the container 111 is viewed from the left. The second connecting end portion 133 is formed to pass through the first end point 133*a* and the third end point 133*b* when the container 111 is viewed from the left.

The grip body portion 134 is reduced in diameter from the second connecting end portion 133 toward the first connecting end portion 132 when the container 111 is viewed from the front (see FIG. 6).

Figure 8:
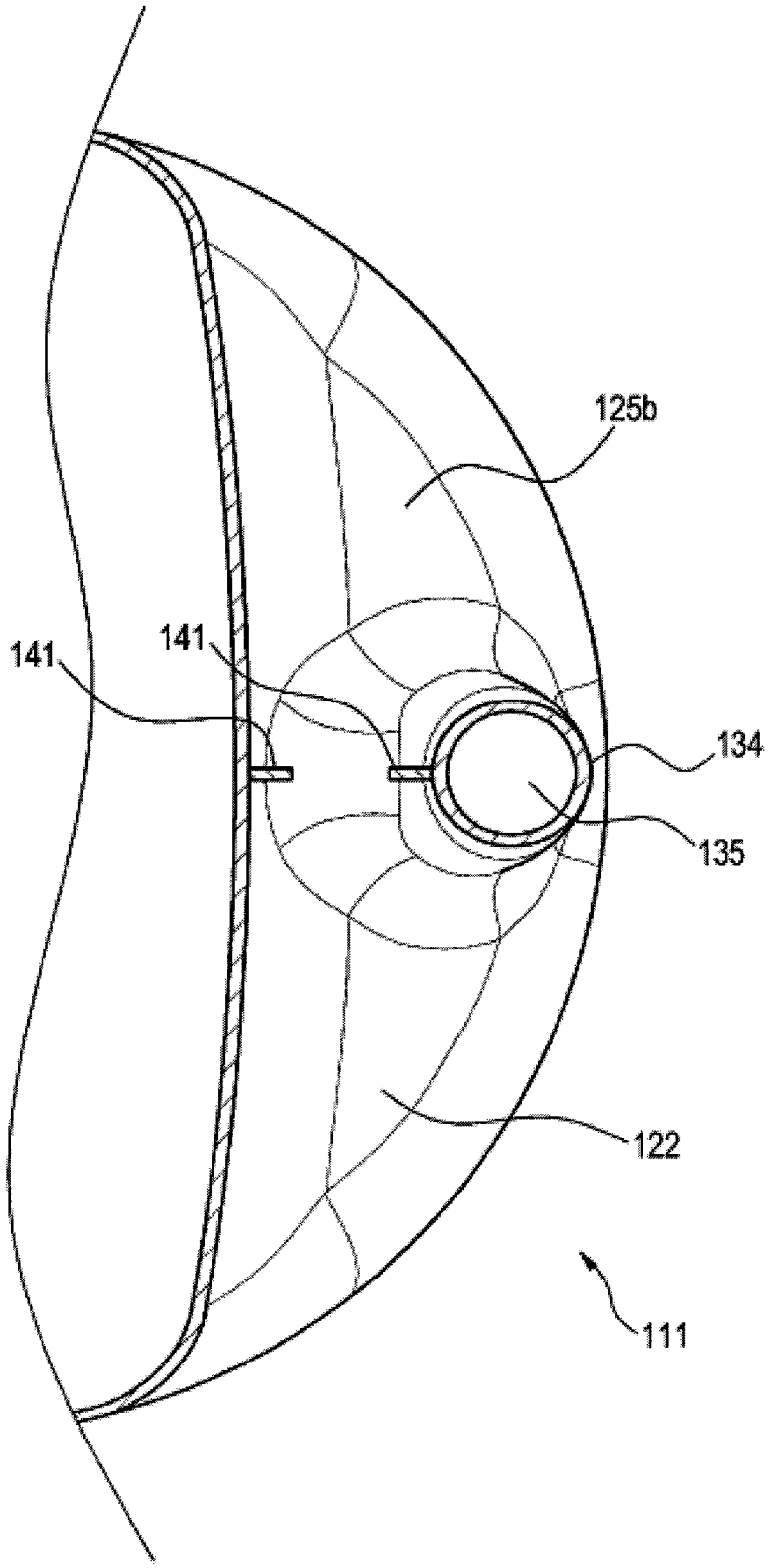
FIG. 8 is a view showing a C2-C2 cross section of the container with handle according to the second embodiment.

FIG. 8 shows a C2-C2 cross section of the side surface portion 122 and the grip portion 131 of the container 111 that is orthogonal to the central axis A2.

An area of a cross section (see (c) of FIG. 7) of the hollow portion 135 cut by a plane which passes through the first end point 133*a* and is orthogonal to the central axis A2 is larger than an area of a cross section (see FIG. 8) of the hollow portion 135 cut by a plane which is at the grip body portion 134 above the first end point 133*a* and below the second end point 132*a* and is orthogonal to the central axis A2. The area of the cross section of the hollow portion 135 cut by a plane which passes through the first end point 133*a* and is orthogonal to the central axis A2 is larger than an area of a cross section (see (a) of FIG. 7) of the hollow portion 135 cut by a plane which passes through the second end point 132*a* and is orthogonal to the central axis A2.

The container 111 of the present embodiment has the same configuration (the area of the cross section of the hollow portion 135 and diameter reduction and curvature of the grip body portion 134) as the container 11 of the first embodiment, so that the same effect as the effect described in the first embodiment is obtained.

In the container 111 of the present embodiment, the first surface 125*a* and the second surface 125*b* are formed to be substantially orthogonal to the central axis A2 in a part excluding a place connecting with the side surface portion 122 other than the third surface 125*c*, the grip portion 131, and the concave portion 125. Thus, rigidity of the concave portion 125 is increased. By increasing the rigidity of the concave portion 125, it is possible to suitably prevent cracking of the container 111 that can occur in the case where the container 111 filled with liquid falls.

In the container 11 of the present embodiment, when the container 111 is viewed from the left, a convex rib portion (fin) 141 along a through hole of the concave portion 125 and the grip portion 131 is formed in a part configuring the through hole. Thus, rigidity of an adjacent area of the convex rib portion including the concave portion 25 is increased. By increasing the rigidity of the adjacent area of the convex rib portion, it is possible to suitably prevent cracking that is easy to occur in the pinch-off portion in a case where the container 111 filled with liquid falls.

In the container 111 of the present embodiment, the height h2 from the horizontal plane to the center of the upper bottom portion 126 is 20 mm or more and 35 mm or less when the container 111 is installed on the horizontal plane with the bottom surface portion 123 facing downward. When the height h2 is 20 mm or more, in the case where the container 111 filled with liquid falls, water hammering action (water hammer) acting on the pinch-off portion can be further reduced since downward elastic deformation of the upper bottom portion 126 increases. This makes it possible to further improve falling resistance of the container 111. An upper limit of the height h2 is particularly preferably 35 mm or less in view of capacity and formability of the container 111.

As described above, according to the embodiment, it is possible to provide a container 111 with handle in which an interior of the handle can be easily washed.

The present invention is not limited to the above embodiments, and modifications, improvements and the like are allowed as appropriate. In addition, materials, shapes, sizes, numerical values, forms, numbers, arrangement places, and the like of components in the above embodiments are arbitrary and not limited as long as the present invention can be achieved.

For example, in the containers 11 and 111 according to the above embodiments, when the containers 11 and 111 are viewed from the front, the grip body portions 34 and 134 may be reduced in diameter from the second connecting end portions 33 and 133 toward the first connecting end portions 32 and 132 part way through, and then, may be increased in diameter.

A weight of liquid substance such as drinking water contained in the containers 11 and 111 reaches about 19 kg to 20 kg. Therefore, the falling resistance of the containers 11 and 111, particularly the pinch-off portion, must be increased.

Concerning the containers 11 and 111, a cross-sectional shape may be circular, a body diameter may be 25 cm to 30 cm (desirably about 27 cm), and a height may be 45 cm to 55 cm (desirably about 49 cm).

The height of the upper bottom portions 26 and 126 is effectively set to 5% to 10% (desirably about 6%) of the body diameter.

The present application is based on Japanese Patent Application No. 2017-093909 filed on May 10, 2017, the entirety of which is incorporated by reference. In addition, all references cited herein are incorporated in their entirety.

REFERENCE SIGN LIST

11, 111: Container with handle, 21, 121: Upper surface portion, 22, 122: Side surface portion, 22*a*, 122*a*: Fourth curve, 22*b*, 122*b*: Third curve, 23, 123: Bottom surface portion, 24, 124: Inlet and outlet portion, 25, 125: Concave portion, 25*a*, 125*a*: First surface, 25*b*, 125*b*: Second surface, 25*c*, 125*c*: Third surface, 26, 126: Upper bottom portion, 27, 127: Peripheral bottom portion, 28: Overhanging portion, 31, 131: Grip portion, 32, 132: First connecting end portion, 32*a*, 132*a*: Second end point, 32*b*, 132*b*: Fourth end point, 33, 133: Second connecting end portion, 33*a*, 133*a*: First end point, 33*b*, 133*b*: Third end point, 34, 134: Grip body portion, 34*a*, 134*a*: First curve, 34*b*, 134*b*: Second curve, 35, 135: Hollow portion, 41, 141: Convex rib portion, A1, A2: Central axis of container with handle, B1, B2: Imaginary line parallel to central axis A1 and A2

The invention claimed is:

1. A container with handle, which is capable of containing a predetermined amount of fluid, the container with handle comprising:

an upper surface portion to which an inlet and outlet portion of liquid is formed;

a side surface portion connected to the upper surface portion;

a bottom surface portion disposed on a side opposite to the upper surface portion and connected to the side surface portion; and a hollow and long grip portion formed to the side surface portion, wherein the grip portion includes:

a first connecting end portion connected with the side surface portion;

a second connecting end portion connected with the side surface portion at a position closer to the bottom surface portion than the first connecting end portion;

a grip body portion disposed between the first connecting end portion and the second connecting end portion; and a hollow portion communicating with an interior of the container, wherein an area of a cross section of the hollow portion cut by a plane, which passes through a first end point of the second connecting end portion closest to a central axis of the container passing through the inlet and outlet portion and is orthogonal to the central axis, is larger than an area of a cross section of the hollow portion cut by a plane which is at the grip body portion and is orthogonal to the central axis, wherein the grip body portion is reduced in diameter from the second connecting end portion toward the first connecting end portion when the container is viewed from the side surface portion side so that the central axis of the container passing through the inlet and outlet portion of the liquid overlaps with the grip body portion, wherein the container is a returnable container that is washed and used repeatedly, wherein a body diameter of the container is 25 cm to 30 cm and a height of the container is 45 cm to 55 cm, wherein, when the container is installed on a horizontal plane with the bottom surface portion facing downward, a height from the horizontal plane to a center of an upper bottom portion of the bottom surface portion is greater than or equal to 20 mm and less than or equal to 35 mm, wherein an overhanging portion that overhangs toward the upper surface portion is formed in the center of the upper bottom portion, wherein the side surface portion has a concave portion to which the first connecting end portion and the second connecting end portion are connected, wherein the side surface portion includes a first surface on an upper surface portion side, a second surface on a bottom surface portion side, and a third surface connecting the first surface and the second surface, and wherein the first surface and the second surface are orthogonal to the central axis in a portion excluding an area connecting with the side surface portion other than the third surface, the grip portion, and the concave portion.

2. The container with handle according to claim 1, wherein the area of the cross section of the hollow portion cut by the plane which passes through the first end point and is orthogonal to the central axis is larger than an area of a cross section of the hollow portion cut by a plane which passes through a second end point of the first connecting end portion closest to the central axis and is orthogonal to the central axis.

3. The container with handle according to claim 1, wherein a surface connected with the first connecting end portion among surfaces configuring the concave portion is inclined so as to come close to the bottom surface portion as the surface comes close to the central axis of the container passing through the inlet and outlet portion of the liquid.

4. The container with handle according to claim 3, wherein a convex rib portion extending along a longitudinal direction of the grip portion is formed on at least a part of the surfaces configuring the concave portion.

5. The container with handle according to claim 1, wherein the grip body portion is curved.

6. The container with handle according to claim 3, wherein a convex rib portion is formed on at least a part of the surfaces configuring the concave portion, and the convex rib portion extends along a through hole between the concave portion and the grip portion.

7. The container with handle according to claim 1, wherein the area of the cross section of the hollow portion cut by the plane which passes through the first end point and is orthogonal to the central axis is a first area, and the first area is larger than a second area of a cross section of the hollow portion cut by a plane which passes through a second end point of the first connecting end portion closest to the central axis and is orthogonal to the central axis.

* * * * *